US007156331B2

(12) United States Patent
Takahashi et al.

(10) Patent No.: US 7,156,331 B2
(45) Date of Patent: Jan. 2, 2007

(54) FLUIDIZED BED PULVERIZING AND CLASSIFYING APPARATUS, AND METHOD OF PULVERIZING AND CLASSIFYING SOLIDS

(75) Inventors: Mutsumi Takahashi, Numazu (JP); Nobuyasu Makino, Numazu (JP); Fumitoshi Murakami, Fuji (JP); Makoto Hirai, Fuji (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 11/326,424

(22) Filed: Jan. 6, 2006

(65) Prior Publication Data

US 2006/0124784 A1 Jun. 15, 2006

Related U.S. Application Data

(63) Continuation of application No. 10/761,285, filed on Jan. 22, 2004, now Pat. No. 7,032,849.

(30) Foreign Application Priority Data

Jan. 23, 2003 (JP) ..... 2003-015063

(51) Int. Cl.
*B02C 19/06* (2006.01)

(52) U.S. Cl. ..... 241/39; 241/57

(58) Field of Classification Search ..... 241/39, 241/57, 38, 47, 3
See application file for complete search history.

(56) References Cited

U.S. PATENT DOCUMENTS

| | | | |
|---|---|---|---|
| 3,376,124 | A | 4/1968 | Hollingsworth |
| 4,553,704 | A | 11/1985 | Wilson et al. |
| 4,602,743 | A | 7/1986 | Nied |
| 4,804,146 | A | 2/1989 | Nied et al. |
| 5,680,996 | A | 10/1997 | Sadler |
| 6,224,004 | B1 | 5/2001 | Kato et al. |
| 2003/0178514 | A1 | 9/2003 | Makino et al. |

FOREIGN PATENT DOCUMENTS

| | | |
|---|---|---|
| JP | 2000-005621 | 1/2000 |
| JP | 2000-015126 | 1/2000 |
| JP | 2000-107626 | 4/2000 |

*Primary Examiner*—Faye Francis
(74) *Attorney, Agent, or Firm*—Oblon, Spivak, McClelland, Maier & Neustadt, P.C.

(57) ABSTRACT

A fluidized bed pulverizing and classifying apparatus is disclosed having a vessel that includes a pulverizing section having a pulverizing nozzle spraying compressed air to pulverize a powder, a classifying section located over the pulverizing section, including a classifying rotor classifying the powder, and a fluidized bed. The vessel also contains a supply of secondary air.

6 Claims, 5 Drawing Sheets

FLUIDIZED BED PULVERIZING AND CLASSIFYING APPARATUS, AND METHOD OF PULVERIZING AND CLASSIFYING SOLIDS

CROSS-REFERENCE OF RELATED APPLICATIONS

This application is a continuation of U.S. application Ser. No. 10/761,285 now U.S. Pat. No. 7,032,849 filed Jan. 22, 2004, and is based upon and claims the benefit of priority from Japanese Patent Application No. 2003-015063 filed on Jan. 23, 2003, the entire contents of which are incorporated herein by reference.

BACKGROUND OF THE INVENTION

1. Field of the Invention

The present invention relates to a pulverizing and classifying apparatus for solids, including but not limited to, minerals, chemicals, and medical substances, such as talcs, limes, ceramics, resins, cosmetics, dyes, and Chinese medicines, and more particularly to a pulverizing and classifying apparatus for a toner.

2. Discussion of the Background

A typical fluidized bed (jet) pulverizer is formed of a pulverizing chamber, a collision member, and a nozzle, wherein the nozzle sprays a rapid gas to pulverize coarse particles. Various suggestions have been made to improve such a fluidized bed pulverizer.

For example, Japanese Laid-Open Patent Publication No. 2000-107626 discloses a method of using multiple tiered nozzles to improve the pulverizability, wherein, for an observer looking into the pulverizer from above, the nozzles do not overlap each other. Japanese Laid-Open Patent Publication No. 2000-15126 discloses a method of positioning a cylindrical board to separate a flow passage leading to a classifier from another leading to a pulverizer. Japanese Laid-Open Patent Publication No. 2000-5621 discloses a method of locating a pyramid-type projection having sloped sides in the shape of isosceles triangles placed at the bottom center of a pulverizing chamber, facing each nozzle, wherein a range is specified for the angle between an axis of a collision member located in a vertical section that includes the nozzle axis and a central axis of the pulverizing chamber.

Conventional pulverizing and classifying methods will now be explained, referring to the fluidized bed apparatus shown in FIG. 1. The fluidized bed pulverizing and classifying apparatus 1 is capable of pulverizing a heated material by spraying compressed air from a pulverizing nozzle 6, causing the temperature of the fluidized bed apparatus to decrease due to the adiabatic expansion of the air, thereby making the fluidized bed apparatus suitable for surface pulverization because of the variation in relative velocity of the accelerating solid material being pulverized induced by the compressed air sprayed into the apparatus.

The material to be pulverized enters a classifying rotor 2 as a coarse powder and is classified as a conforming material. However, the contact between the solid materials being pulverized tend to generate a fine powder.

The above-mentioned conventional technologies are insufficient to improve pulverizability. In order to prevent a coarse powder from slipping into conforming materials and to control the amount of fine powder generated due to excessive pulverization, the present inventors disclose a fluidized bed pulverizing and classifying apparatus in Japanese Laid-Open Patent Publication No. 2002-276526, wherein a pulverizing position adjustor capable of adjusting a distance between the bottom of the pulverizer and the pulverizing nozzle is installed to control the amount of material to be pulverized introduced around the pulverizing nozzle in order to decrease the gas-particle ratio at a classifying rotor such that only the material to be pulverized constantly cover a circumference of the rotor.

Excessive pulverization is prevented by controlling a pulverization pressure in order to reduce particle collision speeds. However, fluidization of the materials to be pulverized deteriorates when the collision speed is reduced, preventing the materials to efficiently reach the classifying rotor and thereby resulting in excessive pulverization due to a deterioration of the particle classification process.

Based at least on the foregoing reasons, a need exists for a new fluidized bed pulverizing and classifying apparatus that has a simple constitution and a high capacity while maintaining a high degree of flexibility.

SUMMARY OF THE INVENTION

Accordingly, an object of the present invention is to provide a new fluidized bed pulverizing and classifying apparatus in which the behavior of the material to be pulverized is better controlled in a classifying chamber even when a large amount thereof is fed, a gas-particle ratio does not abnormally increase around a classifying rotor located above the classifying chamber, particle classification performance does not deteriorate, the material is not excessively pulverized, a coarse powder does not mix with conforming materials, and production capacity does not deteriorate.

Another object of the present invention is to provide a pulverizing and classifying method using the fluidized bed pulverizing and classifying apparatus.

Briefly, these and other objects of the present invention, as hereinafter will become more readily apparent, can be attained by a fluidized bed pulverizing and classifying apparatus including a pulverizing nozzle spraying compressed air to pulverize a powder; a classifying rotor classifying the powder; and means for supplying a flow of secondary air that is different from the flow of compressed air.

The flow rate $Q_2$ of the secondary air and the flow rate $Q_1$ of the compressed air of the pulverizing nozzle preferably have the following relationship:

$$\frac{Q_1}{20} \leq Q_2 \leq \frac{2Q_1}{20}.$$

In addition, a supply pressure P of the secondary air flow in the fluidized bed pulverizing and classifying apparatus is preferably controlled so as to satisfy the following relationship:

$$-10\ \text{kPa} \leqq P \leqq 3\ \text{kPa}.$$

These and other objects, features, and advantages of the present invention will become apparent upon consideration of the following description of the preferred embodiments of the present invention taken in conjunction with the accompanying drawings.

BRIEF DESCRIPTION OF THE DRAWINGS

Various other objects, features, and attendant advantages of the present invention will be more fully appreciated as the same becomes better understood from the detailed description when considered in connection with the accompanying drawings in which like reference characters designate like corresponding parts throughout and wherein:

FIG. 1(*b*) is a top view of the bottom portion of the apparatus illustrated in FIG. 1(*a*);

FIG. 2(*b*) is a schematic top view of the bottom portion of the fluidized bed of the apparatus illustrated in FIG. 2(*a*);

FIG. 2(*c*) is another schematic top view of the bottom portion of the fluidized bed of the apparatus of FIG. 2(*a*);

DETAILED DESCRIPTION OF THE INVENTION

Generally, the present invention provides a fluidized bed pulverizing and classifying apparatus having a simple constitution, being flexible, and having a high capacity.

Problems of conventional pulverizing and classifying methods will be explained further in detail, referring to the fluidized bed pulverizing and classifying apparatus in FIG. 1.

Figure 1:
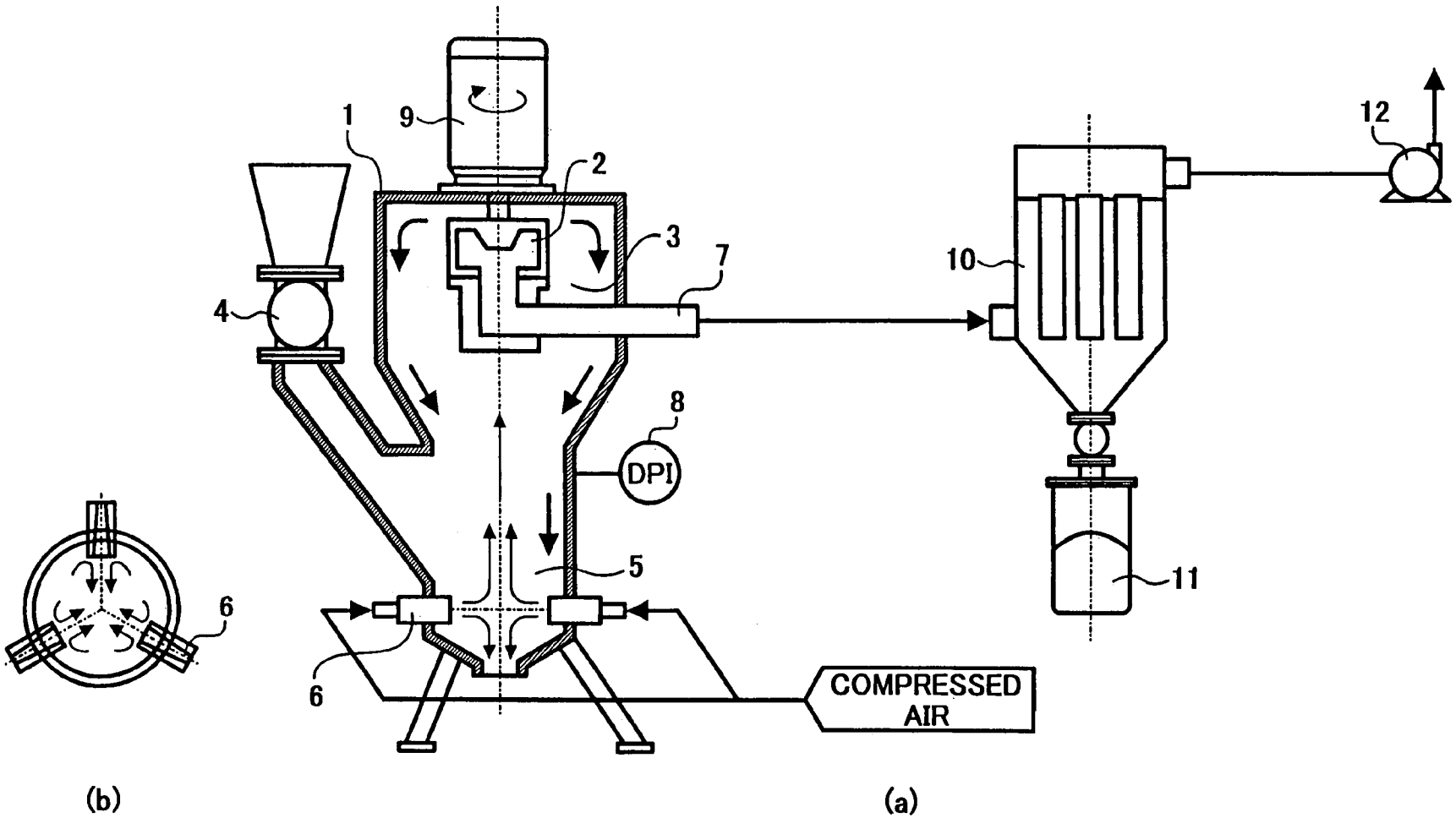
FIG. 1 Prior Art
FIG. 1(*a*) is a schematic view illustrating a cross-section of a conventional fluidized bed pulverizing and classifying apparatus.

In FIG. 1, an updraft from a pulverizing section 5 to a classifying section 3 in the fluidized vessel is mostly generated by the compressed air sprayed from the pulverizing nozzles 6 and the discharge air from a pulverizing blower 12, although it is also influenced by the rotational speed of the classifying rotor 2.

Normally, the pressure of the compressed air sprayed from the pulverizing nozzles 6 and the rotational speed of the classifying rotor 2 are determined based on the final particle size range of the material to be pulverized. Further, the amount of air discharged from the pulverizing blower 12 is controlled by fixing the pressure in the fluidized vessel.

Thus, the updraft from the pulverizing section 5 to the classifying section 3 in the fluidized vessel occasionally varies depending on the operating conditions. For example, when the updraft is not strong enough, a portion of the pulverized material having a desired particle diameter cannot reach the classifying section 3 and is pulverized again, resulting in the generation of a fine powder having a particle diameter smaller than desired.

To the contrary, when the updraft is too strong, the final pulverized material includes a coarse powder of improperly pulverized material gathered around the classifying section 3.

In the present invention, supply of a secondary air flow, in addition to the compressed air sprayed from the pulverizing nozzles 6, controls updraft from the pulverizing section 5 to the classifying section 3 for any desired operating conditions. It is another feature of the present invention that the air supplier vertically and intermittently sprays the secondary air from the bottom of the vessel toward the fluidized bed and the classifying rotor through the pulverizing section.

In addition, when compressed air sprayed from the pulverizing nozzles 6 collide with the material being pulverized and a portion thereof occasionally flows downward and does not reach the classifying section 3, resulting in the generation of many fine powders having a particle diameter smaller than desired as the falling particles are pulverized again.

To solve this problem, the secondary air flow is effectively supplied from the bottom of the fluidized vessel at a position below the location of the pulverizing nozzles 6, thereby transporting upward toward the classifying section 3 the material having the undesirably small particle diameter.

When the updraft is too strong, the final pulverized material is mixed with a coarse powder that gathers around the classifying section 3, thereby increasing the gas-particle ratio at the classifier and deteriorating the precision of the classification process. To solve this problem, it is possible to supply the secondary air in a direction tangential to a region in the middle between the classifying rotor 2 and the upper part of the fluidized vessel. Further, it is preferable that the secondary air be supplied from both the bottom of the fluidized vessel and in a direction tangential to a region in the middle between the classifying rotor 2 and the upper part of the fluidized vessel to transport the material having a particle diameter smaller than desired to the classifying section 3, thereby preventing an increase of the gas-particle ratio at the classifier.

Figure 2:
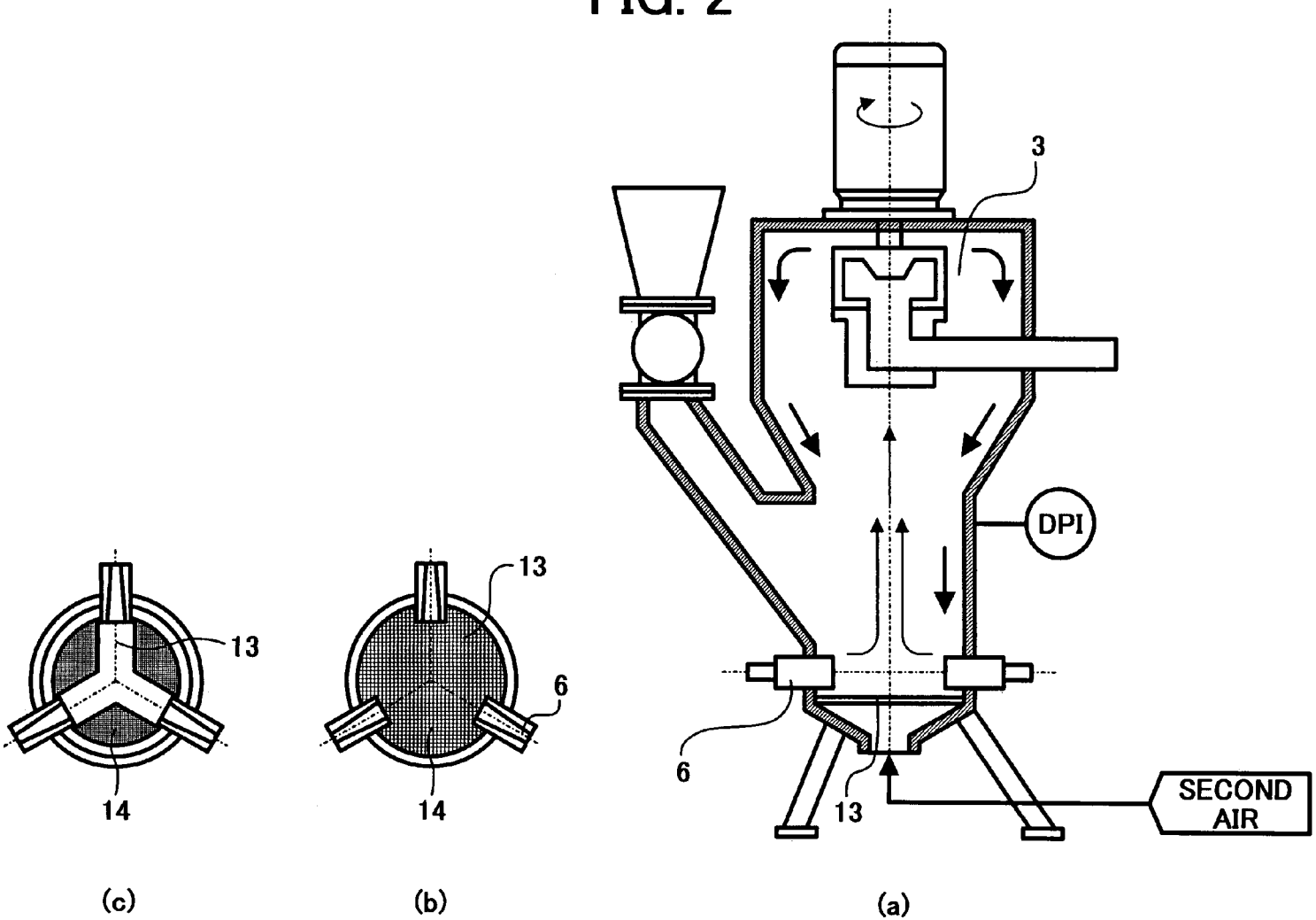
FIG. 2(*a*) is a schematic view illustrating a cross-section of an embodiment of the fluidized bed pulverizing and classifying apparatus of the present invention.
Figure 3:
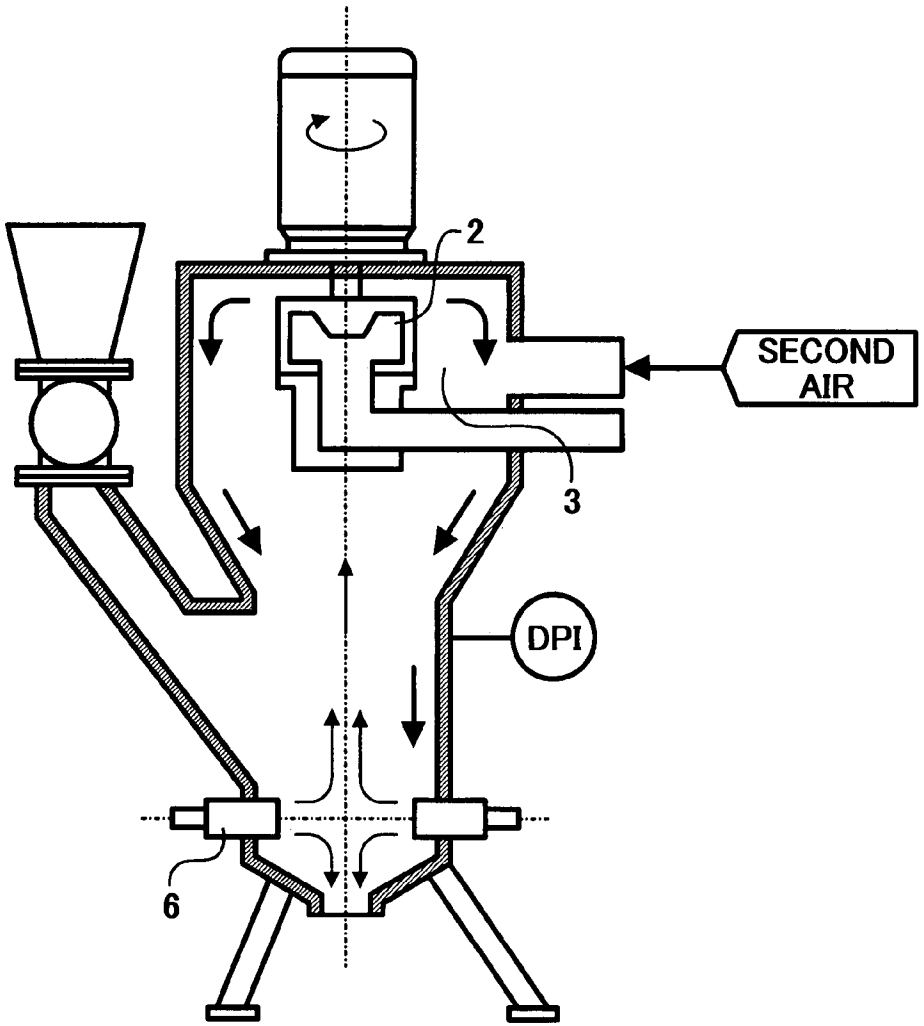
FIG. 3 is a schematic view illustrating a cross-section of another embodiment of the fluidized bed pulverizing and classifying apparatus of the present invention.

As shown in FIG. 2(*a*), when the materials fed from a feeder 4 are pulverized by the pulverizing nozzles 6, the secondary air introduced underneath the fluidized bed 13 located on the bottom of the pulverizing section 5 preferably fluidizes and elevates the materials having the desired particle diameter to the classifying section 3 to prevent excessive pulverization. It is also possible to locate the fluidized bed 13 in the pulverizing and classifying apparatus of the present invention at a location below the pulverizing nozzles 6.

In addition, when stagnant materials deposited on the bottom of the fluidized bed are fluidized, they can be unevenly caught by the spray of compressed air from the pulverizing nozzles 6, thereby being acceleratedly collided with each other. Therefore, the materials, particularly coarse particles, can effectively be pulverized.

To effectively fluidize the inside of the fluidized vessel and improve the pulverizing capacity thereof, a supply pressure P of the secondary air in the fluidized bed pulverizing and classifying apparatus is preferably controlled so as to satisfy the following relationship:

$$-10\ \text{kPa} \leqq P \leqq 3\ \text{kPa}.$$

The pressure in the fluidized vessel is measured by a pressure gauge 8. When P is greater than 3 kPa, the back-pressure of the material to be pulverized increases and the pulverization collision speed decreases, resulting in the deterioration of the pulverizing capacity of the fluidized bed pulverizing and classifying apparatus. Further, the updraft in the fluidized vessel decreases and the materials to be pulverized are not sufficiently fed to the classifying section 3, resulting in the deterioration of classifying capacity. When P is less than −10 kPa, a gas-particle ratio around the sprays of compressed air from the pulverizing nozzles 6 decreases, resulting in the deterioration of the pulverizing capacity. Further, the amount of material fed to the classifying section 3 increases and coarse particles are mixed therein, also resulting in the deterioration of the classifying capacity.

FIG. 2(*a*) is a schematic view illustrating a cross-section of an embodiment of the fluidized bed pulverizing and classifying apparatus of the present invention. The fluidized bed 13 is located on the bottom of the fluidized vessel, at a position lower than that of the pulverizing nozzles 6, and the secondary air is supplied from beneath the fluidized bed 13. FIG. 2(*b*) is a schematic top view illustrating the bottom of the fluidized vessel in the apparatus and FIG. 2(*c*) is another schematic top view illustrating the bottom of the fluidized vessel. In FIG. 2(*b*), a filter 14 covers the entire fluidized bed 13. In FIG. 2(*c*), the filter 14 is disposed on the fluidized bed 13 so as not to block the flow path of the compressed air sprayed from the pulverizing nozzles 6.

The filter is preferably made of overlapped and sintered SUS material having a mesh size ranging from about 80 (180 μm) to about 250 (63 μm), but not limited thereto. A flow rate $Q_2$ of the secondary air and the flow rate $Q_1$ of the compressed air of the pulverizing nozzle preferably have the following relationship:

$$\frac{Q_1}{20} \leq Q_2 \leq \frac{2Q_1}{20}.$$

When $Q_2$ is less than $Q_1/20$, the inside of the fluidized vessel is not sufficiently fluidized, resulting in excessive pulverization and contamination of the final product with an excessive amount of fine particles. When $Q_2$ is greater than $3Q_1/20$, coarse particles are elevated to the classifying section 3, resulting in the mixing of coarse particles with the final product.

The pressure of the compressed air supplied to the pulverizing nozzles 6, the rotational speed of the classifying rotor 2, and the amount of air discharged from the pulverizing blower 12 are controlled. However, these tend to vary depending on variations of the air flow rate from the compressor, the load of the motor 9 of the classifying rotor 2 due to a change of the gas-particle ratio in the classifying section 3 and the rotational speed of the classifying rotor 2, and the updraft from the pulverizing section 5 to the classifying section 3.

Figure 4:
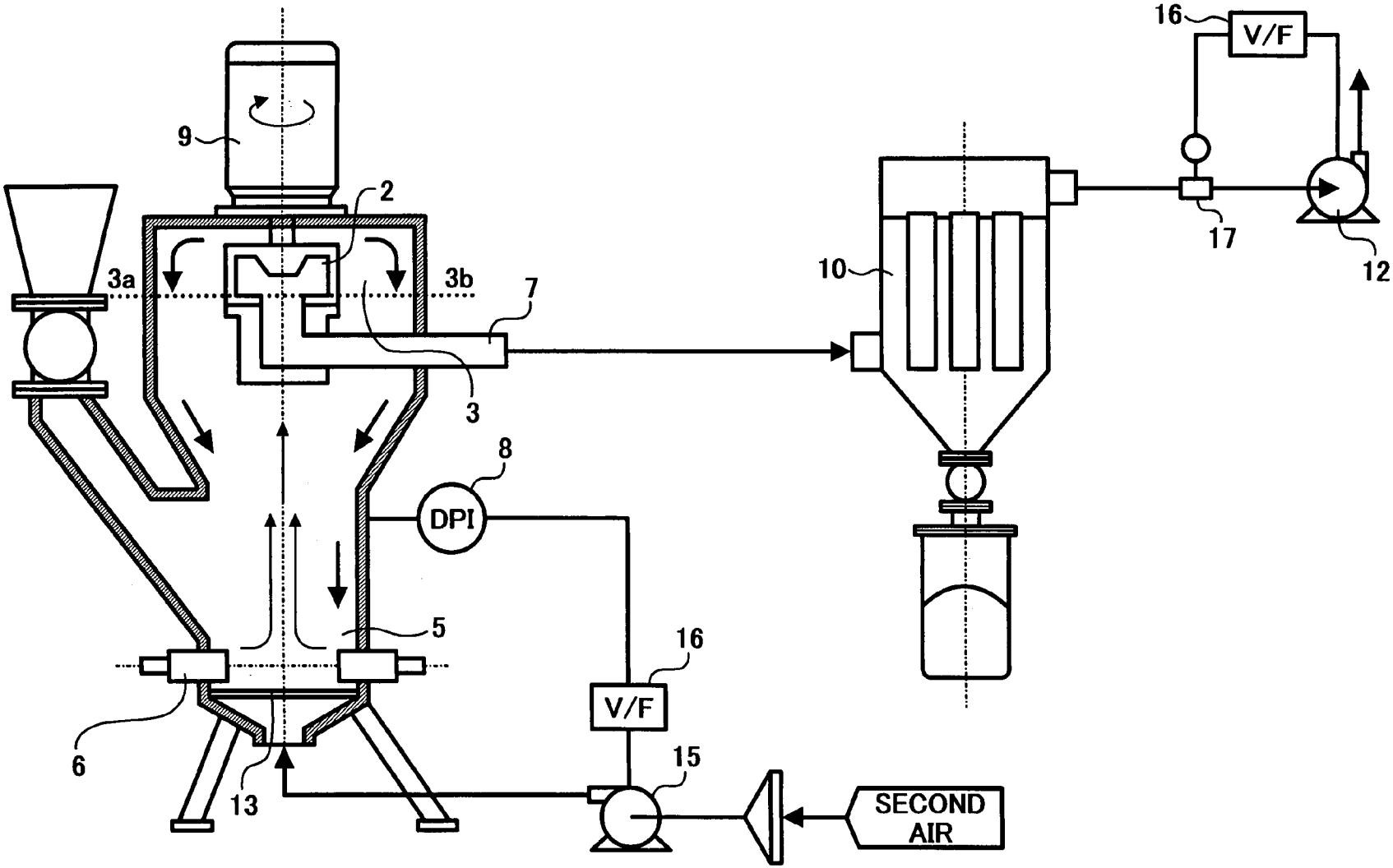
FIG. 4 is a schematic view illustrating a cross-section of still another embodiment of the fluidized bed pulverizing and classifying apparatus of the present invention.

FIG. 4 is a schematic view illustrating a cross-section of still another embodiment of the fluidized bed pulverizing and classifying apparatus of the present invention. As shown in FIG. 4, the fluidized bed pulverizing and classifying apparatus of the present invention, having a pressure gauge 8 to control the supply of the secondary air as a function of the pressure in the fluidized vessel, and a flowmeter 17 at an exit of the apparatus to control the amount of air discharged, can stabilize the updraft from the pulverizing section 5 to the classifying section 3.

The secondary air is supplied by a supplying blower 15. A pressure in the fluidized vessel is detected by the pressure gauge 8 and the detected pressure signal is sent to an inverter 16 to control the rotational speed of the supplying blower 15 and the amount of the secondary air. In addition, the amount of discharge air is controlled by the flowmeter 17 located at the exit of the bug filter 10.

Figure 5:
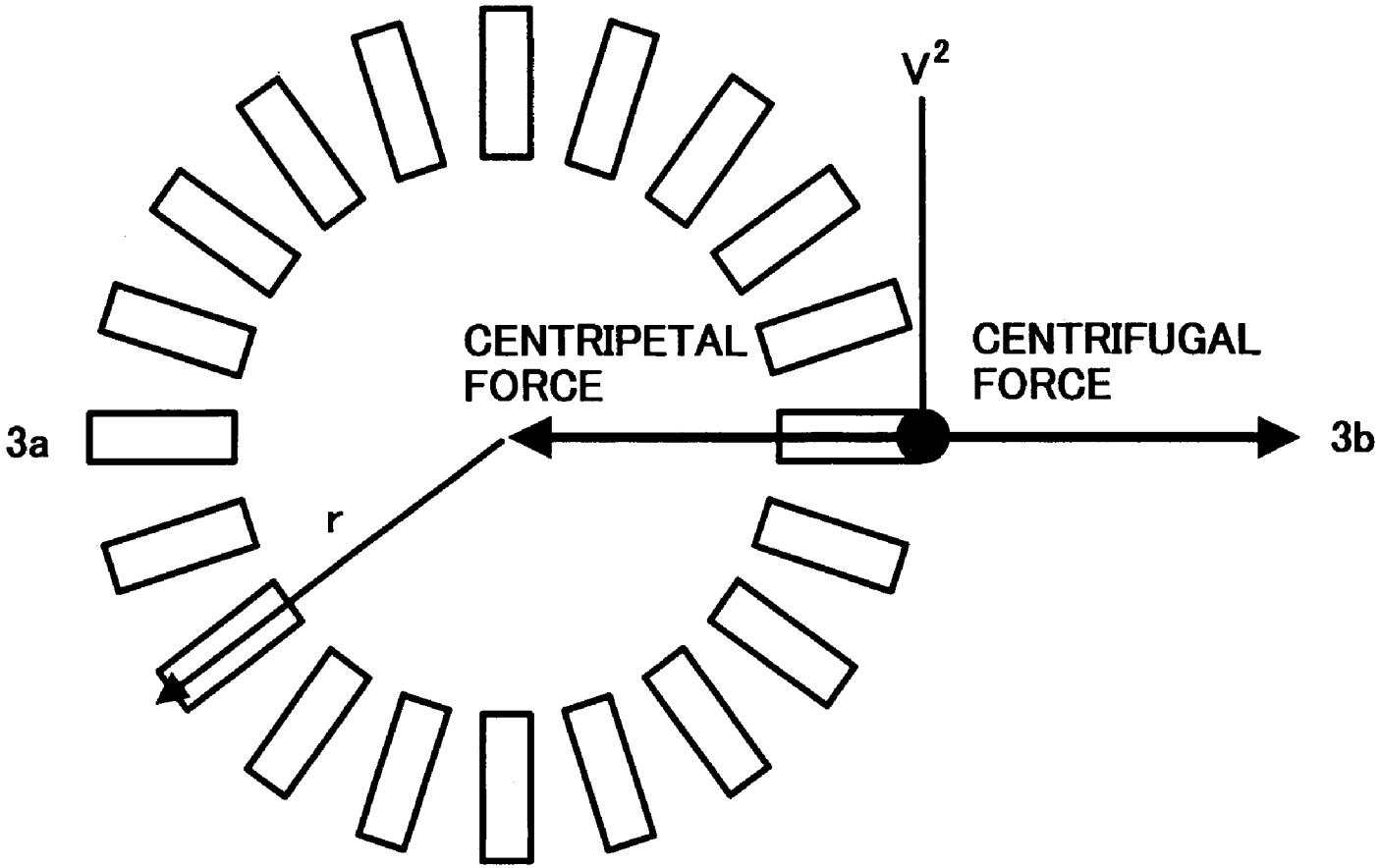
FIG. 5 is a schematic view illustrating cross-sections 3*a* and 3*b* of the classifying rotor 2 in FIG. 4.

FIG. 5 is a schematic view illustrating cross-sectional views along lines 3*a* and 3*b* of the classifying rotor 2 in FIG. 4. A velocity of a toner particle V (m/s) of mass m(kg) at a position r(m) results in the centrifugal force F given by the following formula:

$$F=mv^2/r.$$

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

A mixture of 75% by weight of a polyester resin, 10% by weight of a styrene-acrylic copolymer and 15% by weight of carbon black was kneaded upon application of heat by a rolling mill. Then, the kneaded mixture was cooled to be hardened, and the hardened mixture was crushed by a hammer mill to prepare a toner material. The toner material was pulverized in a fluidized bed pulverizing and classifying apparatus supplying the secondary air from the bottom of the fluidized bed at a location lower than the position of the pulverizing nozzles under the conditions of a compressed air pressure at the pulverizing nozzles of 0.5 MPa, a peripheral speed of the classifying rotor of 40 m/s and a pressure in the fluidized vessel of −5 KPa. As a result, a toner having a volume-averaged particle diameter of 6.5 μm was prepared at a rate of 13 kg/hr with no greater than 58% of the distribution being a fine powder less than 4 μm on a number basis and a coarse powder having a volume-averaged particle diameter not less than 16 μm of 1.0% by weight. The particle diameters were measured by a Multisizer® from Beckman Coulter Inc.

Comparative Example 1

The procedures for preparation of the toner in Example 1 were repeated to prepare a toner except for pulverizing the toner material in a conventional apparatus as the one shown in FIG. 1. As a result, a toner having a volume-averaged particle diameter of 6.6 μm was prepared at rate of 10 kg/hr with no greater than 61% of the distribution being a fine powder less than 4 μm on a number basis and a coarse powder having a volume-averaged particle diameter not less than 16 μm of 1.2% by weight.

Example 2

The procedures for preparation of the toner in Example 1 were repeated in a fluidized bed pulverizing and classifying apparatus supplying the secondary air in a direction tangential to a region between the classifying rotor a location toward the upper part of the fluidized vessel. As a result, a toner having a volume-averaged particle diameter of 6.5 μm was prepared at a rate of 12 kg/hr with no greater than 59% of the distribution being a fine powder less than 4 μm on a number basis and a coarse powder having a volume-averaged particle diameter not less than 16 μm of 0.8% by weight.

Example 3

The procedures for preparation of the toner in Example 1 were repeated in a fluidized bed pulverizing and classifying apparatus supplying the secondary air from both the bottom of the fluidized vessel and in a direction tangential to a region between the classifying rotor and a location toward the upper part of the fluidized vessel. As a result, a toner having a volume-averaged particle diameter of 6.5 μm was prepared at a rate of 15 kg/hr with no greater than 56% of the distribution being a fine powder less than 4 μm on a number basis and a coarse powder having a volume-averaged particle diameter not less than 16 μm of 0.7% by weight.

Example 4

The procedures for preparation of the toner in Example 1 were repeated to prepare a toner in a fluidized bed pulverizing and classifying apparatus as shown in FIG. 2, equipped with a fluidized bed including a sintered filter made of hard polyethylene, having a porosity of 35% and a thickness of 5 mm, and being located at a position so as not to block the flow path of the compressed air sprayed from the pulverizing nozzle. In the apparatus of Example 4, the secondary air was supplied from beneath the fluidized bed. As a result, a toner having a volume-averaged particle diameter of 6.5 μm was prepared at a rate of 17 kg/hr with no greater than 55% of the distribution being a fine powder less than 4 μm on a number basis and a coarse powder having a volume-averaged particle diameter not less than 16 μm of 0.6% by weight.

Example 5

The procedures for preparation of the toner in Example 4 were repeated to prepare a toner in a fluidized bed pulverizing and classifying apparatus as shown in FIG. 4 equipped with a pressure gauge to control the supply of secondary air depending on the pressure in the fluidized vessel and a flowmeter at the exit of the apparatus to control the amount of air discharged. In the pulverizer of Example 5, the secondary air was supplied from beneath the fluidized bed. As a result, a toner having a volume-averaged particle diameter of 6.5 μm was prepared at a rate of 17 kg/hr with no greater than 54% of the distribution being a fine powder less than 4 μm on a number basis and a coarse powder having a volume-averaged particle diameter not less than 16 μm of 0.5% by weight.

Having now fully described the invention, it will be apparent to one of ordinary skill in the art that many changes and modifications can be made thereto without departing from the spirit and scope of the invention as set forth in the claims herein below.

What is claimed as new and desired to be secured by Letters Patent of the United States is:

1. A fluidized bed pulverizing and classifying apparatus comprising:

a vessel comprising:

a pulverizing section comprising at least one pulverizing nozzle located above the fluidized bed configured to spray compressed air to pulverize a powder, a classifying section located over the pulverizing section, comprising a classifying rotor configured to classify the powder, and a fluidized bed; and an air supplier configured to supply secondary air in the vertical direction from a nozzle located below the fluidized bed and in the tangential direction from a nozzle located between the classifying rotor and the upper part of the fluidized vessel.

2. The fluidized bed pulverizing and classifying apparatus of claim 1, wherein a flow rate $Q_2$ of the secondary air and a flow rate $Q_1$ of the compressed air of the pulverizing nozzle have the following relationship:

$$\frac{Q_1}{20} \leq Q_2 \leq \frac{2Q_1}{20}.$$

3. The fluidized bed pulverizing and classifying apparatus of claim 1, wherein a supplying pressure P of the secondary air in the fluidized bed pulverizing and classifying apparatus is controlled to satisfy the following relationship:

−10kPa#*P*#3kPa.

4. The fluidized bed pulverizing and classifying apparatus of claim 1, wherein the air supplier intermittently sprays the secondary air vertically from the bottom of the vessel toward the fluidized bed and the classifying rotor through the pulverizing section.

5. The fluidized bed pulverizing and classifying apparatus of claim 4, wherein the fluidized bed is located below the at least one pulverizing nozzle and above the nozzle configured to deliver secondary air in the vertical direction.

6. The fluidized bed pulverizing and classifying apparatus of claim 1, further comprising:

a pressure gauge configured to measure a pressure in the vessel, wherein the flow rate of the secondary air is configured to be controlled based on said pressure on said vessel; and a flowmeter located at an exit of the pulverized powder and configured to measure and control an amount of air discharged from the exit.

* * * * *